United States Patent [19]

Adams

[11] 4,109,597

[45] Aug. 28, 1978

[54] ELECTRO-MECHANICAL ACTUATOR

[75] Inventor: Kenneth D. Adams, Madison, N.J.

[73] Assignee: The Singer Company, New York, N.Y.

[21] Appl. No.: 829,405

[22] Filed: Aug. 31, 1977

[51] Int. Cl.[2] ..... D05B 3/02

[52] U.S. Cl. ..... 112/158 E

[58] Field of Search ..... 112/158 E, 158 A, 158 D, 112/220; 74/25, 838; 318/567, 687

[56] References Cited

U.S. PATENT DOCUMENTS

| | | | |
|---|---|---|---|
| 3,699,910 | 10/1972 | Urciola et al. | 112/158 A |
| 3,929,081 | 12/1975 | Ketterer | 112/158 E X |
| 3,984,745 | 10/1976 | Minalga | 112/158 E |

*Primary Examiner*—Peter Nerbun

*Attorney, Agent, or Firm*—William V. Ebs; E. L. Bell; R. E. Smith

[57] ABSTRACT

An electro-mechanical actuator for sewing machine instrumentalities which allows settings to be made electrically using low level electrical signals, and then acts upon such signals mechanically using power derived from the sewing machine drive. Cam-actuated feeler elements are urged by the sewing machine drive to close upon an inclined surface, previously positioned in accordance with a low level electrical input signal by, for example, a galvanometer, resulting in an angular displacement of the feeler elements proportionate to the positioning of the inclined surface.

4 Claims, 5 Drawing Figures

ELECTRO-MECHANICAL ACTUATOR

BACKGROUND OF THE INVENTION

This invention is concerned with the control and regulation of sewing machine instrumentalities, more particularly, with the control of needle position in zigzag sewing machines and with the regulation of feed of a variable feed system therefor.

In order to control the stitch forming instrumentalities of a sewing machine electronically, control systems have been devised which upon receipt of a signal, activate an electric solenoid or actuator to adjust, for example, the needle jogging mechanism or the material feed. In one type of known control system of this character, the signal receiving unit performs the actual adjustment of the machine instrumentality. This control system requires a signal receiving unit relatively large in size to provide the mechanical power necessary for moving the sewing machine instrumentality. In addition, due to the size and mechanical power output required of the signal receiving unit, the electrical power consumed by the unit must also be relatively large.

SUMMARY OF THE INVENTION

The object of this invention is to provide an electromechanical actuator for sewing machine instrumentalities which is responsive to the setting of a guide member, positioned by a low level electrical signal, for urging the sewing machine instrumentalities to a specific location relative to said electrical signal by means of the main drive means for the sewing machine. Thus, a galvanometer is responsive to a low level electrical signal to position an inclined surface linearly with respect to the sewing machine frame. A pair of opposing feelers on the ends of primary levers pivoted on a common axis fixed to the sewing machine frame conduct the inclined surface intermittent to the motion thereof under the urgings of a cam means driven by the main drive means of the sewing machine. With a change in position of the inclined surface, the feelers contact a different location thereon requiring, therefore, a rotation of the primary levers. By means of secondary levers and linkages, this rotation of the primary levers is transferred to the sewing machine instrumentalities.

DESCRIPTION OF THE DRAWINGS

With the above and additional objects and advantages in view as will hereinafter appear, the invention will be described with reference to the drawing of the preferred embodiment.

DESCRIPTION OF THE PREFERRED EMBODIMENT

Figure 1:
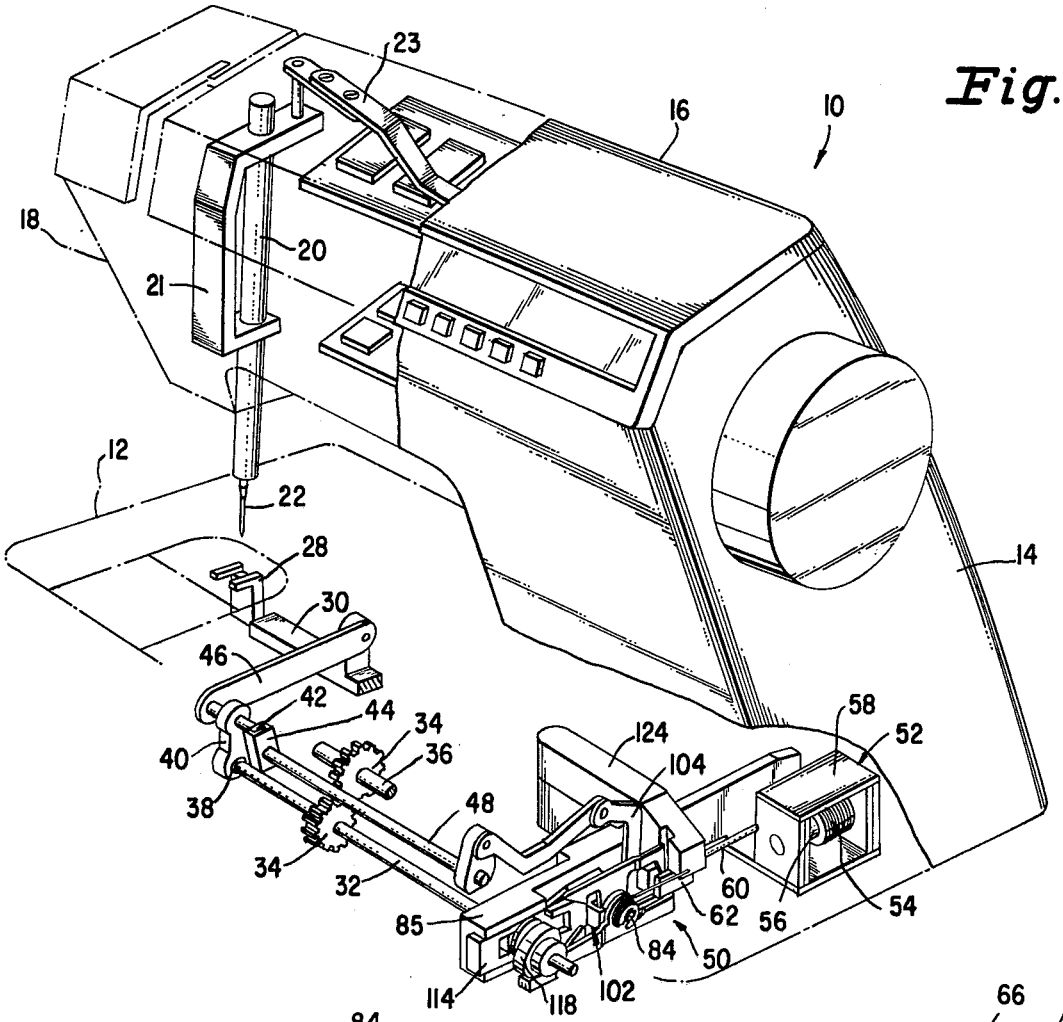
FIG. 1 is a perspective view of a sewing machine having the electro-mechanical actuator of this invention incorporated therein.
Figure 2:
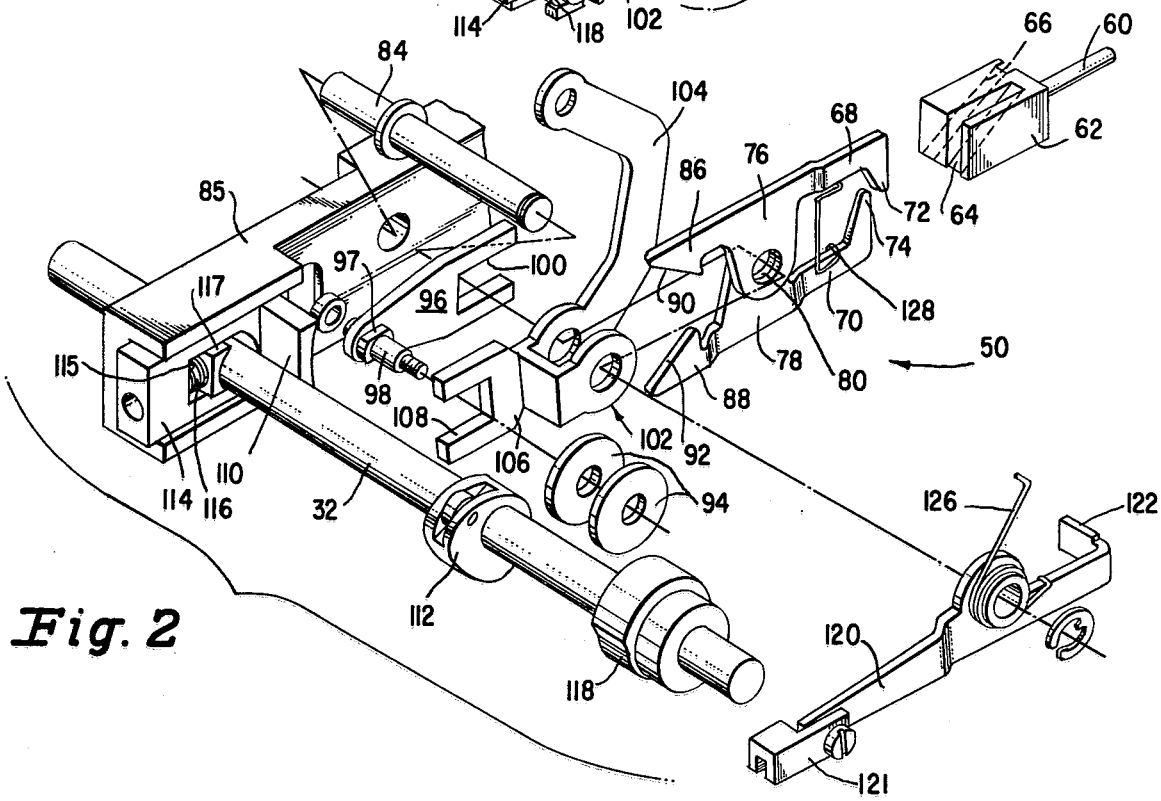
FIG. 2 is an exploded perspective view of the electromechanical actuator.

Referring to the drawings of the preferred embodiment, a sewing machine is generally referred to by the reference number 10. The sewing machine 10 includes a bed 12, a hollow standard 14 rising from the bed 12, and a bracket arm 16 projecting from the standard 14 and over-hanging the bed 12 and terminating in a sewing head 18. Carried within the sewing head is a reciprocating needle bar 20 to the end of which is attached a thread carrying needle 22. The needle bar 20 is supported for endwise reciprocation in a needle bar gate 21 pivotally mounted within the sewing head 18 to accommodate lateral jogging of the needle 22 under the urgings of driving arm 23, connected to the gate 21 and to an actuator as described hereinbelow.

A work feeding mechanism is shown in FIG. 1 and includes a feed dog 28 carried by a feed bar 30. The mechanism for imparting work feeding movement to the feed dog 28 includes a feed drive shaft 32 driven by gears 34 from a bed shaft 36, which, in turn, is driven by a motor (not shown), a cam 38 on the feed drive shaft 32, a pitman 40 embracing the cam 38 and arranged to reciprocate a slide block 42 along a slotted feed regulating guide 44. A link 46 pivotally connects the pitman 40 with the feed bar 30 so that, depending upon the inclination of the guide 44, the magnitude and direction of feed, in relation to the motion of the feed dog 28 will be determined. The inclination of the guide 44 may be influenced by manipulation of a rock shaft 48 which is secured to the guide 44. In this embodiment, the electromechanical actuator 50 of this invention is used to manipulate the rock shaft 48.

The electro-mechanical actuator 50 includes a galvanometer 52 having an electrical coil 54 slidably disposed on a guide 56, which coil 54, when excited, moves linearly in a magnetic field, produced by a magnetized frame 58, to a position dependent upon the magnitude of the excitation. A rod 60 attaches the galvanometer coil 54 to a block 62 having co-planar inclined surfaces, 64 and 66, opening each on opposite sides thereof. A pair of limbs 68 and 70 are provided having end portions in the form of feelers, 72 and 74, respectively, for engaging the inclined surfaces 64 and 66 of block 62. Located substantially at the center of each of said limbs 68 and 70 are enlarged sections, 76 and 78, respectively, having coaxial holes 80 formed therethrough for pivotally mounting said limbs 68 and 70 on a common support pin 84. The support pin 84 is affixed to a frame 85 which, in turn, is mounted within the bed 12 of the sewing machine 10.

The opposite ends 86 and 88 of limbs 68 and 70, respectively, are formed with ramp surfaces, 90 and 92, respectively, for engaging rollers 94. The rollers 94 are rotatably carried by a support pin 98 which is mounted on a floating swinging carrier 96. The swinging carrier 96 is formed with an open-ended slot 100 straddling the support pin 84. Co-located on support pin 84 for pivotal motion is a swinging frame 102 having a first portion 104 extending therefrom for eventual connection to the rock shaft 48 of the feed mechanism. A second portion 106 of the swinging frame 102 is formed with an open-ended slot 108 therein straddling an enlarged slabbed section 97 of the support pin 98 on the swinging carrier 96. By referring to FIGS. 1 through 4, it can be seen that any swinging movement of the swinging carrier 96 will be transferred to the swinging frame 102.

A sliding cam follower 110 is provided, engaging on one side the rollers 94 and engaging on the other side thereof an edge cam 112 mounted on the feed shaft 32. The cam follower 110 is mounted to a holder 114 which is slideably mounted in the frame 85. A slot 115 is formed in the holder 114 allowing the feed shaft 32 to pass therethrough. Biasing means in the form of spring 116 and slide block 117 are provided for maintaining positive engagement of the cam follower 110 with cam 112.

Mounted adjacent to cam 112 on feed shaft 32 is a second cam 118 for influencing movement of a locking lever 120 which is also pivotally mounted on support pin 84. The locking lever 120 has an end portion 122 formed to engage block 62 such that, in conjunction with a stop 124, supported in the bed 12, the locking lever 120, in response to the cam 118, will intermittently clamp the block 62. Biasing means in the form of spring 126 maintain positive engagement of the slide 121 of the locking lever 120 with the cam 118.

A spring 128 is also provided to urge the feelers, 72 and 74, of limbs 68 and 70, apart.

In operation, when a low level electrical signal is applied to the galvanometer coil 54, the coil 54 moves linearly along guide 56 to a position relative to the magnitude of the input signal. The movement of the coil 54 in turn positions the block 62. Now after the block 62 is positioned, cam 118 causes locking lever 120 to press the block 62 against stop 124, arresting any further movement thereof. Continuing the turning of cam 112 causes the cam follower 110 to shift radially away from the bed shaft 36. The movement of cam follower 110 forces the rollers 94 between the ramp surfaces 90 and 92 of limbs 68 and 70, respectively, causing the feelers, 72 and 74, thereof to engage the inclined surfaces 64 and 66 of block 62 in opposition to spring 128. Dependent on the positioning of block 62, the engaging of the feelers 72 and 74 with the inclined surfaces 64 and 66 of block 62 forces the limbs 68 and 70 to pivotally shift about the support pin 84. This pivotal shift is carried over to the swinging carrier 96 by the rollers 94 attached to support pin 98, which movement is then transferred through the swinging frame 102 to the feed mechanism.

Figure 3:
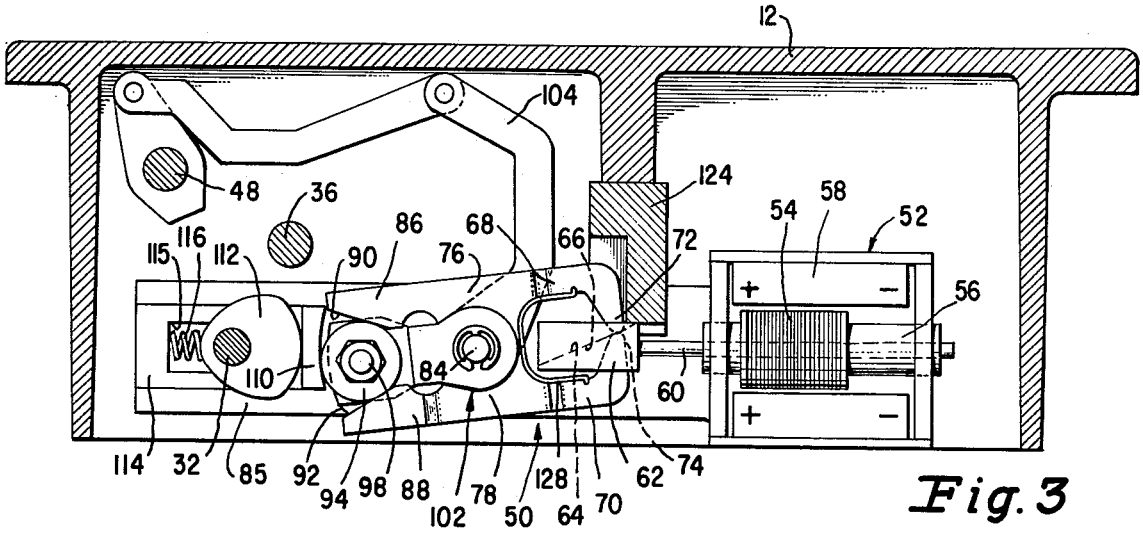
FIG. 3 is a cross-sectional view of the bed of the sewing machine shown in FIG. 1, with some parts of the actuator removed to clearly show one extreme position thereof.
Figure 4:
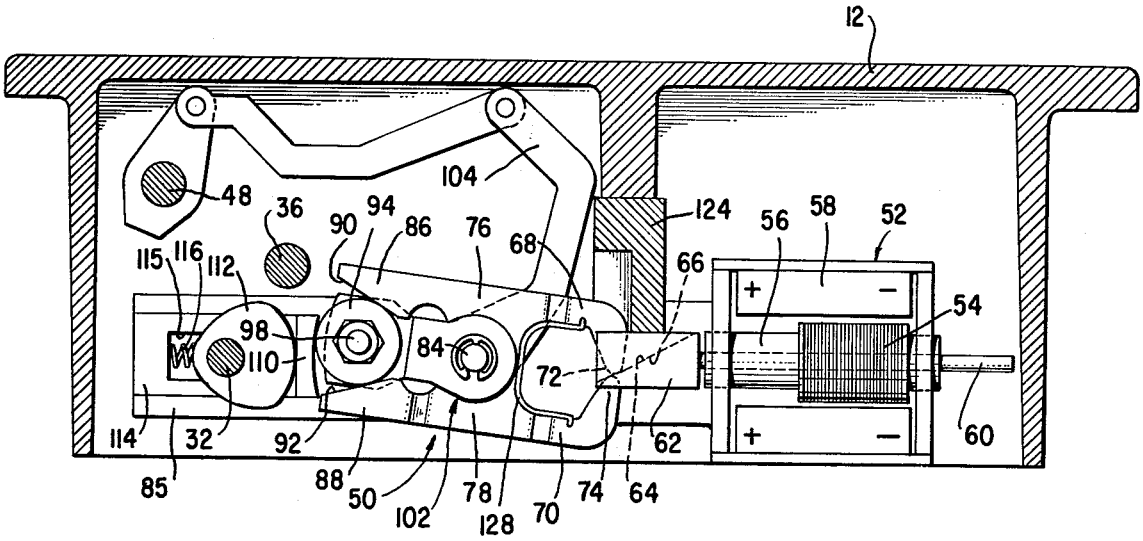
FIG. 4 is a cross-sectional view as in FIG. 3 but showing the other extreme position of the electromechanical actuator.

The electro-mechanical actuator 50 of this invention may also be used to influence jogging of the needle bar 20, by applying the output of a similar actuator (not shown) to the driving arm 23, by means of a linkage arrangement similar to that disclosed hereinabove, and clearly depicted in FIGS. 3 and 4 at both extremes of operation.

Figure 5:
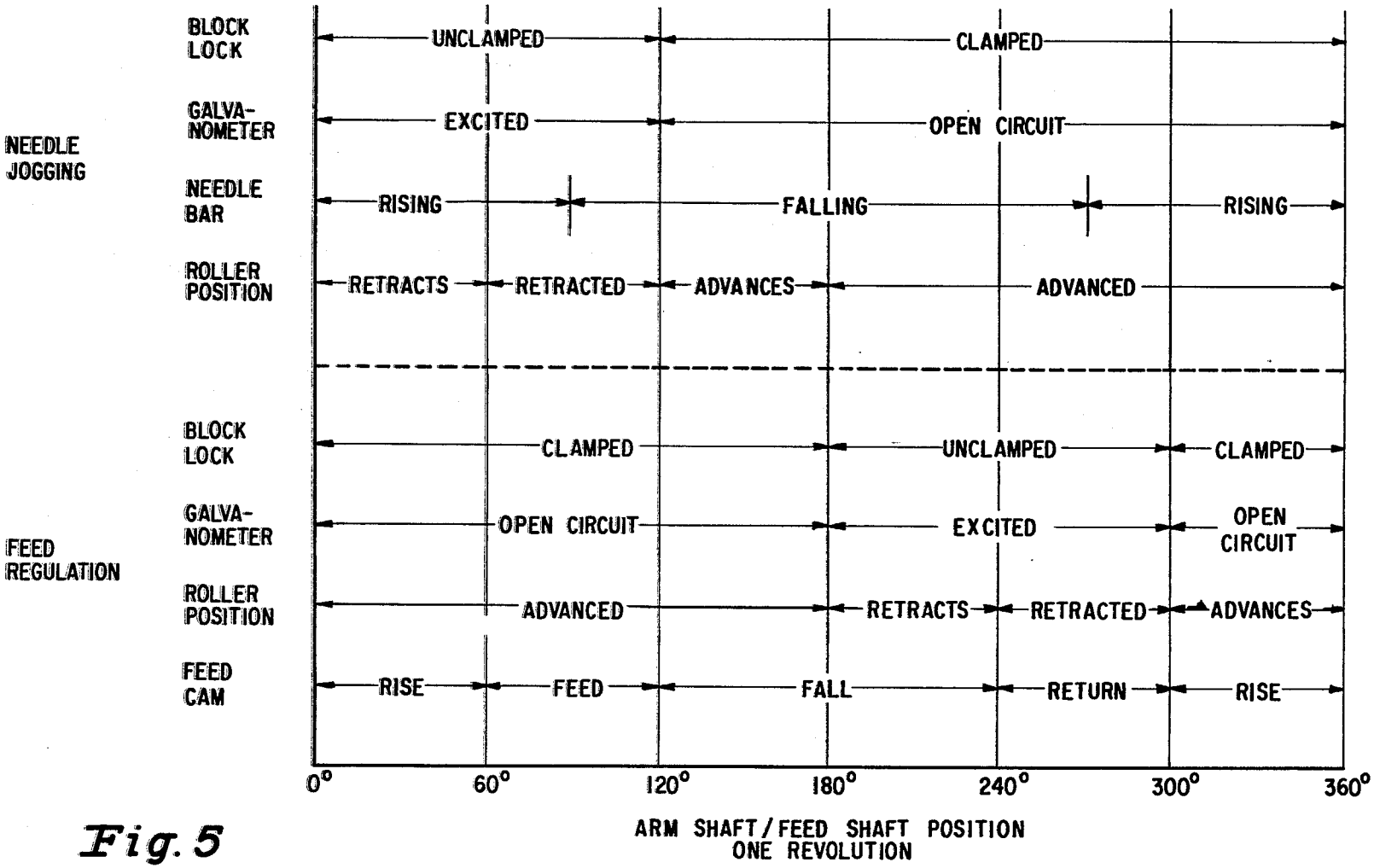
FIG. 5 is a timing chart indicating the required synchronization between the various components of the electro-mechanical actuators for needle positioning and feed control for one revolution of either the arm shaft or the feed shaft of a sewing machine completing one stitch cycle.

The timing chart of FIG. 5 indicates the states of the components of the electro-mechanical actuator 50 relative to their specifically controlled component of the sewing machine 10 and to each other. Thus when the needle 22 has placed a stitch in a work piece, the block 62 is unclamped by the action of the cam 118 on locking lever 120, so that the galvanometer 52 may reposition the block 62 and the inclined surfaces, 64 and 66, thereof while the needle is rising. Concurrently, as the needle 22 rises, the rollers 94 retract from the ramp surfaces, 90 and 92 of the limbs 68 and 70 respectively, to release their respective feelers 72 and 74 in order to permit the block 62 to more freely in response to the low level electrical signal applied to the galvanometer coil 54. After the block 62 is repositioned, it is once again clamped by the locking lever 120 and the rollers 94 advance to a forward position to cause the limbs 68 and 70 to assume a new angular positon relative to the position of the block 62.

The feed regulation takes place similarly as the needle jogging with, however, the respective events occurring at differing times in the cycle as shown in FIG. 5.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of this invention, what I herein claim is:

1. In a sewing machine having a drive shaft, stitch forming instrumentalities which includes a variable feed mechanism, a feed shaft driven by said drive shaft, and means for generating a low level variable electrical signal corresponding to desired positions of said stitch forming instrumentalities, an electro-mechanical actuator comprising:

a movable block having a pair of coplanar inclined surfaces opening on opposite sides thereof;

means for intermittently positioning said block in response to said electrical signal;

a pair of adjacent limbs having opposing feelers for closing upon said inclined surfaces, said limbs being pivotally mounted such that the angular positioning of said limbs will vary dependent on the position of said block;

means for closing and opening said limbs alternately to operation of said positioning means; and, means cooperating with said limbs for transferring the movement of said limbs derived from the varying angular position thereof, to said stitch forming instrumentality.

2. An electro-mechanical actuator as set forth in claim 1 wherein said stitch forming instrumentalities further include a needle bar capable of being jogged in the formation of zig-zag stitches.

3. An electro-mechanical actuator as set forth in claim 1 wherein said means for positioning said block comprises a galvanometer having an electrical coil linearly movable within a magnetic field in response to said low level electrical signal.

4. An electro-mechanical actuator as set forth in claim 1 wherein said means for closing and opening said limbs comprises rollers and a cam driven by said feed shaft and acting upon said rollers such that said rollers are intermittently urged between said limbs by said cam.

* * * * *